US006068578A

United States Patent [19]

Wang

[11] Patent Number: 6,068,578

[45] Date of Patent: May 30, 2000

[54] BUFFER STRUCTURE INSTALLED IN-BETWEEN THE FRAMEWORK OF JOGGING MACHINE AND THE FLOOR SURFACE

[76] Inventor: Leao Wang, No. 1, Lane 154, Charng Long Rd., Taiping, Taichung, Taiwan

[21] Appl. No.: 09/096,527

[22] Filed: Jun. 12, 1998

[51] Int. Cl.[7] ..... A63B 22/00

[52] U.S. Cl. ..... 482/54

[58] Field of Search ..... 482/51, 54

[56] References Cited

U.S. PATENT DOCUMENTS 5,474,510 12/1995 Chen ..... 482/54

*Primary Examiner*—Glenn E. Richmon

[57] ABSTRACT

This invention is relating to a buffer structure to be installed in between the framework of jogging machine and the floor surface. The jogging machine is comprised of one framework, one front floor-rod, one hand holder and one rear floor-rod, etc. components. Amid the components, framework has a jogging board installed on its end surface. And one jogging track is enclosed to surface of this jogging board on its up and down end. Thus this installation can enable user to stand on jogging track and start jogging exercise. The key point here is that there is a pulling board transversely pivoted to the top end of two bent chips incorporated to rear floor-rod. And one side of the pulling board has a pivot lug to pivot an adjustment screw rod. Then let this screw rod pass through the holes drilled on the front & rear partition boards and place a buffer pad in between front and rear partition boards. Finally use one screw rod socket and one knob to bolt screw rod together. After the buffer pad is installed, it can effectively absorb the gravity that framework is carrying. It can also lessen the reaction force fed back by floor surface, and further to weaken the vibration phenomena created when framework is stressed.

3 Claims, 4 Drawing Sheets

BUFFER STRUCTURE INSTALLED IN-BETWEEN THE FRAMEWORK OF JOGGING MACHINE AND THE FLOOR SURFACE

BACKGROUND OF THE INVENTION

1. Field of the invention

This invention relates to the buffer structure of a jogging machine, more particularly, to an erected buffer structure between the framework and the floor surface can effectively absorb the gravity that framework is bearing. Meanwhile, it can lessen the reaction force fed back by the floor surface so that the vibration phenomena of framework can be weakened.

2. Description of the Prior Art

The so-called jogging machine is a track-type indoor sport equipment. Its typical assembly is to have one front floor-type upright rod and one rear floor-type upright rod installed at front-end base and rear-end base of the jogging machine framework respectively. They can set the jogging board slightly slanted and stick to ground (standby position before usage) when the framework is formally placed. At this time, user can run on the jogging track to enjoy the jogging exercise. Under this condition, the jogging board and machine framework have to carry the weight of user and the gravity generated by user's athletic movement while the machine is entertaining the user.

Thus, for example, according to U.S. Pat. Nos. 5,441,468, 5,279,528 and 5,454,772, etc. (as shown on FIGS. 1,2,3). There is a block-type or strip-type buffer pad 12 horizontally placed either at inner side frame 11 or on upper surface of machine framework. The jogging board 14 is stably placed on buffer pad 12. Under this arrangement, buffer pad 12 will develop its effect to weaken the vibration phenomena given from the loaded framework 10 and jogging board 14 when jogging board is being loaded.

Although the structure of buffer pad 12 described in the precedent of consuetudiary patent can accomplish certain expected effects, however, we still can find out variation if we conduct a closer observation. The buffer pad 12 will be affected by longitudinal gravity up and down when jogging board 14 is being loaded. The generated gravity will pass through buffer pad 12 and transfer its load to front and rear upright rods (not shown on the Figure), and finally reach the floor surface. Afterward, floor surface will feed back its reaction force to framework 10 and jogging board 14. As a result, framework 10 and jogging board 14 will surely create extremely large vibration phenomena because of the reaction force caused by floor surface. In another words, when the stress is demonstrating an up and down athletic state in longitudinal direction, the buffer pad 12 can only absorb small portion of the stress, It can not properly lead the stress to else place in order to lessen the influence occurred to machine body.

Certainly, although it is an unavoidable fact that jogging board 14 and framework 10 will create vibration phenomena while being loaded, however, it won't puzzle the user too much. In contrast, the user will very easily to sense his muscle fatigue if he is affected by too much vibrating stress while doing the exercises. The worse case is to let user have the occurrence of dizzy and uncomfortable symptoms. If this uncomfortable symptom indeed happen, then it's really a satire on this health and fitness equipment, especially it's designed to improve the health.

SUMMARY OF THE INVENTION

This invention is to provide a buffer pad structure that can appropriately and transversely lead the stress in order to largely weaken the vibration phenomena so that stress won't cause to much impact to framework of the machine body and jogging board. This is the main objective of this invention.

BRIEF DESCRIPTION OF THE DRAWINGS

In order to more fully describe the drawings used in the detailed description of the present invention, a brief description of each drawing is provided.

DETAILED DESCRIPTION OF THE INVENTION

Figure 1:
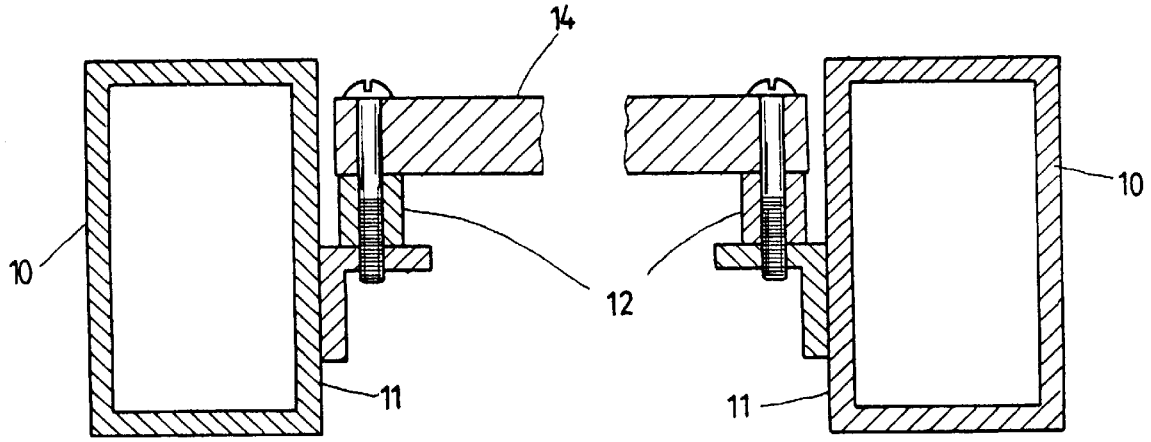
FIG.1 PRIOR ART
FIG. 1 is a schematic drawing of a known buffer pad structure and its location.
Figure 3:
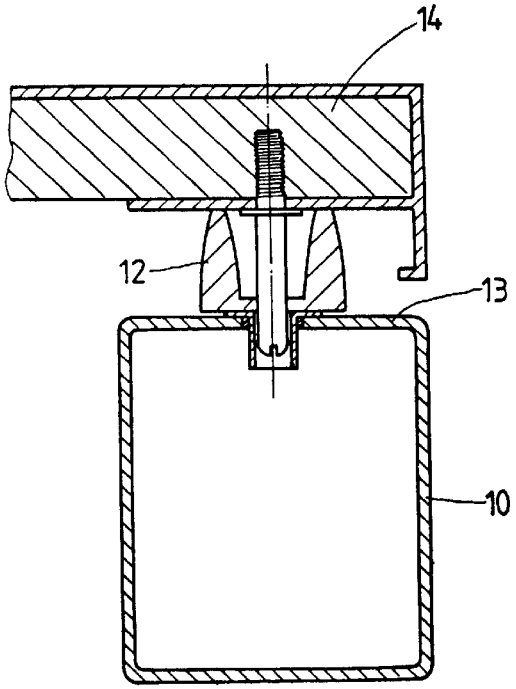
FIG.3 PRIOR ART
FIG. 3 is a schematic drawing of another known buffer pad structure and its location.
Figure 2:
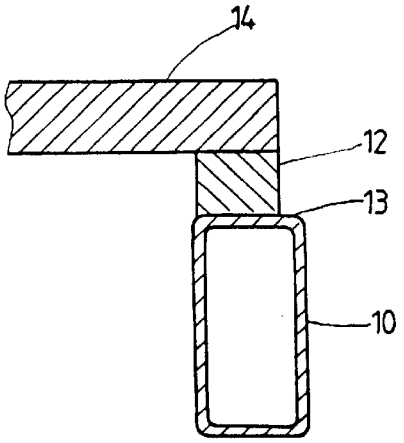
FIG.2 PRIOR ART
FIG. 2 is a schematic drawing of another known buffer pad structure and its location.
Figure 4:
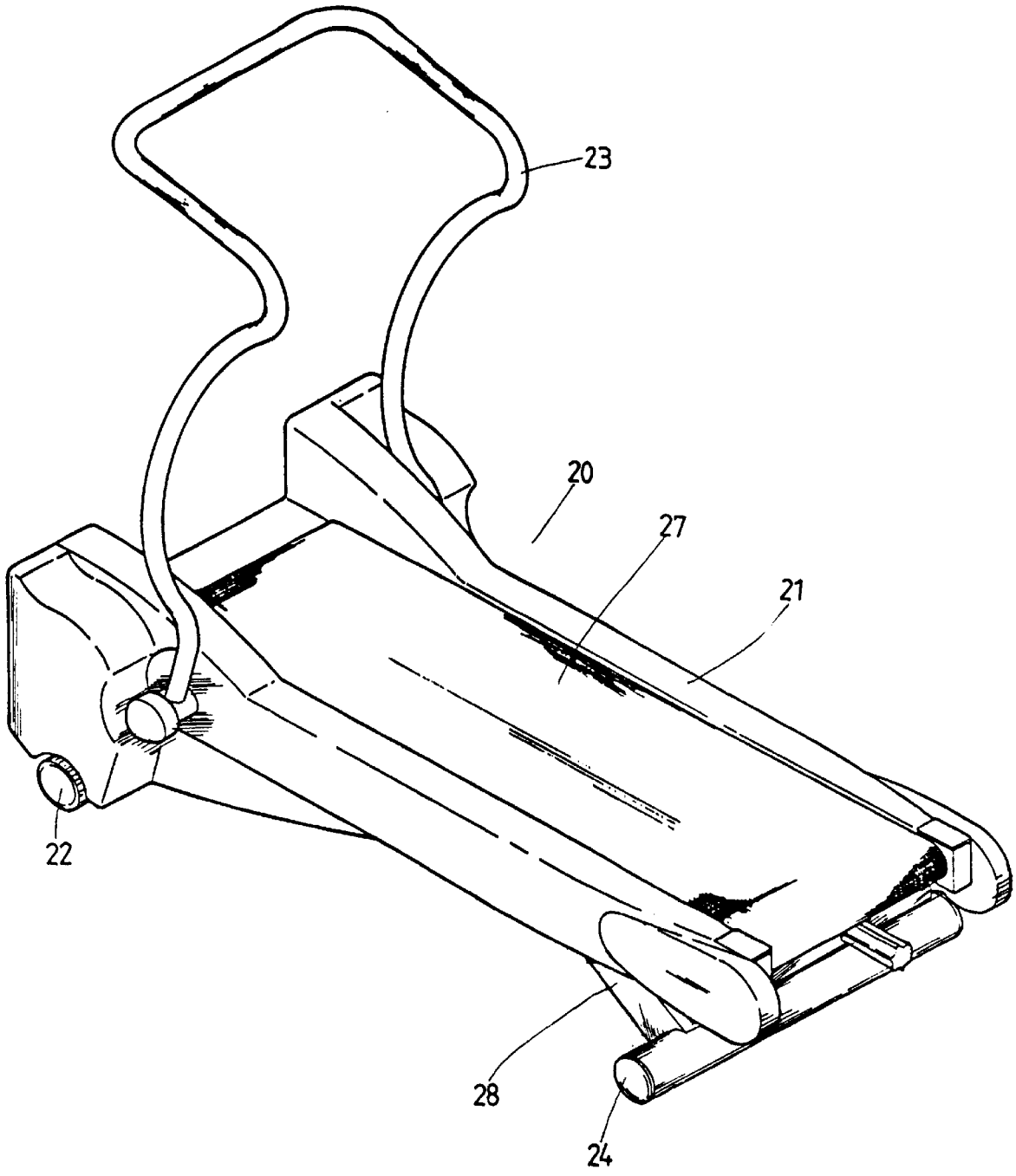
FIG. 4 is a perspective view of a jogging board having a buffer pad of the present invention.
Figure 5:
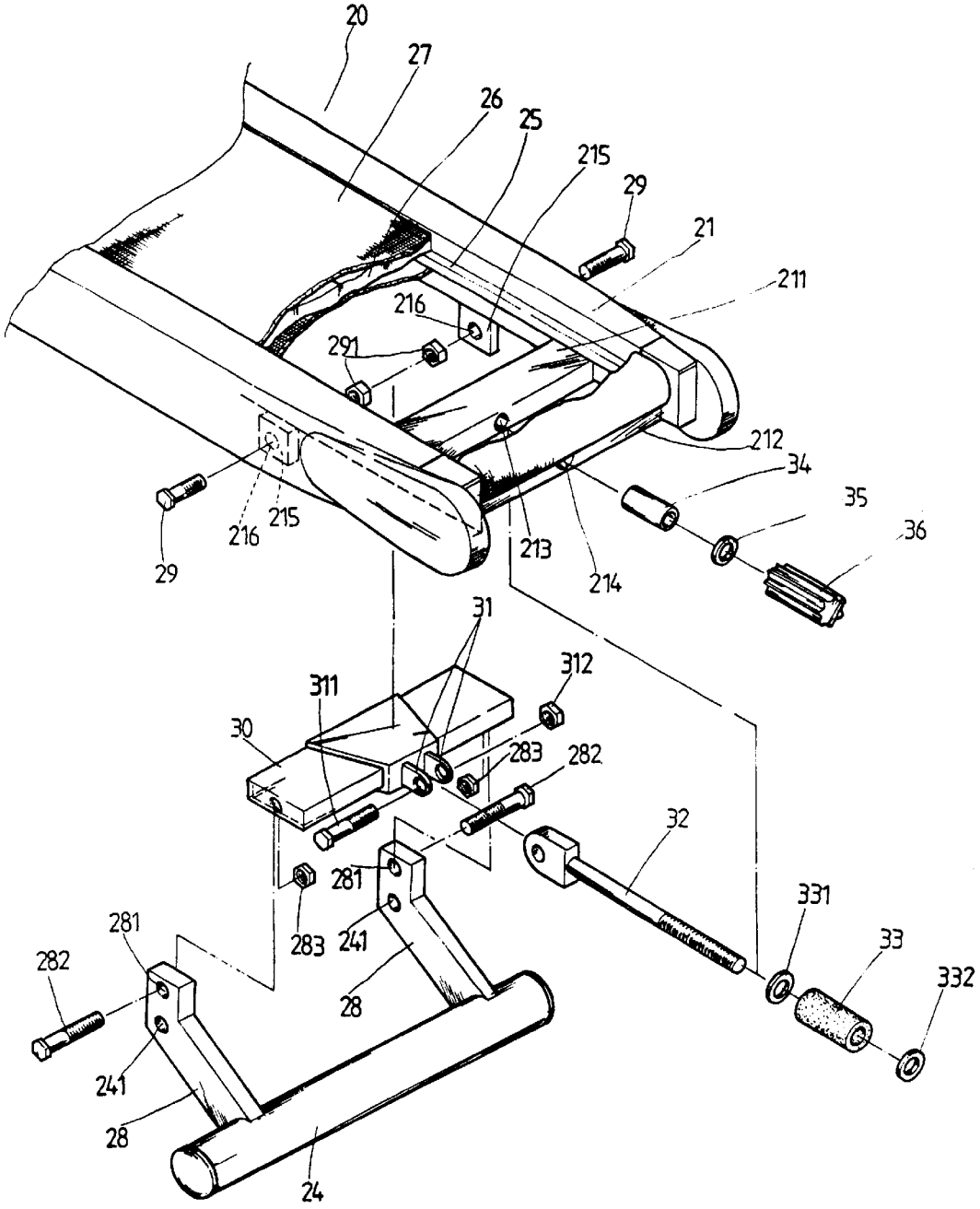
FIG. 5 is an exploded perspective view of the present invention.

First of all, please refer to FIG. 4 and FIG. 5, the body (20) of jogging machine is comprised of one framework (21), one front upright floor-rod (22), one hand holder (23) and one rear upright floor-rod (24). The suspension strip 25 located at an inner side of framework 21 has been equipped with jogging board 26. The jogging track 27 is fitted to roller 271 and enclosed to up and down end surface of jogging board 26. This installation enables the user to stand on jogging track 27 and start jogging.

There is a pivot chip 215 properly positioned at both sides of base end surface in framework 21. The rear floor-rod 24 is pivoted by pivot chip 215, the relative positioning holes 241 & 216, and the fitting bolt 29 and nut 291.

Figure 6:
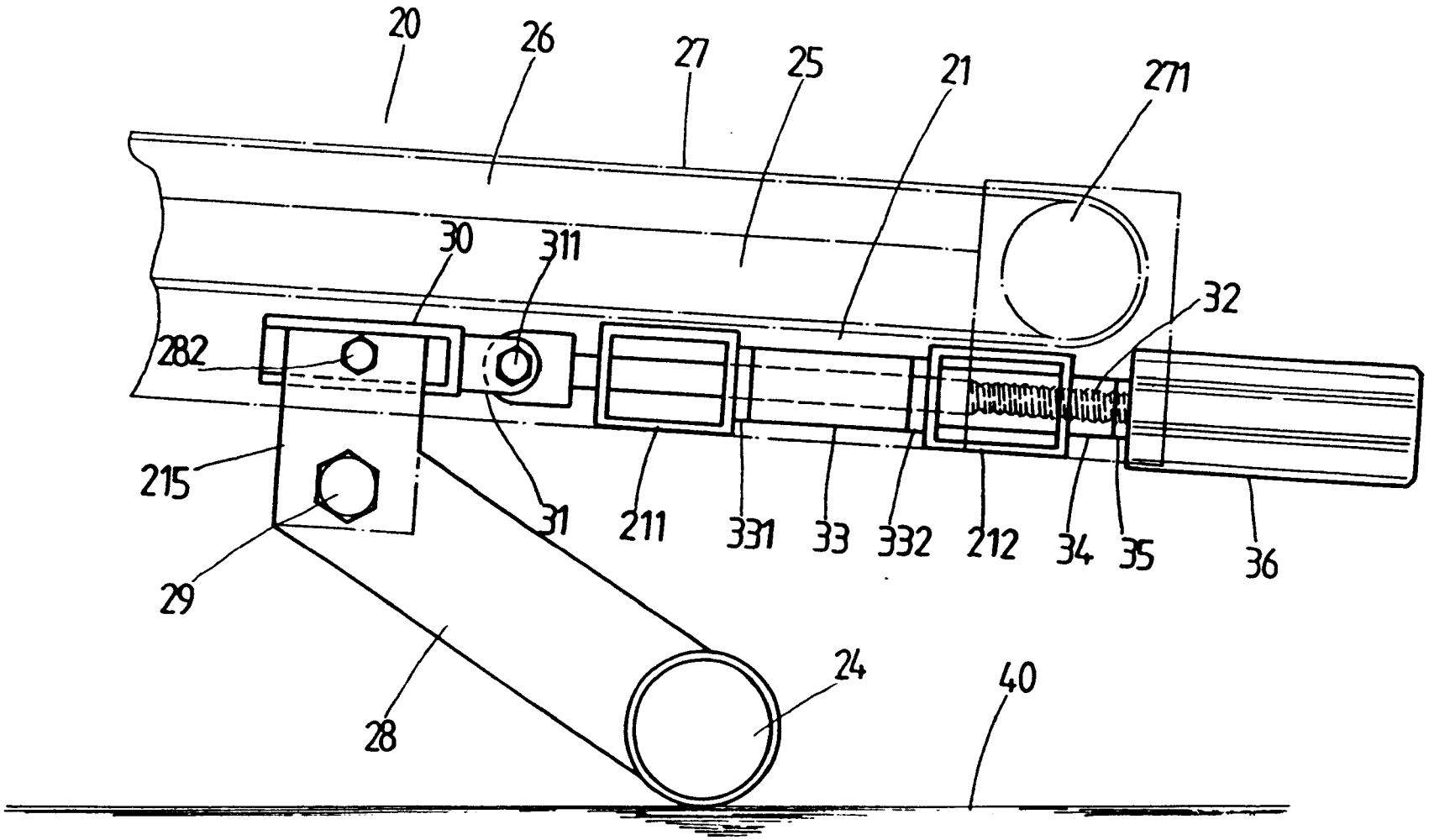
FIG. 6 is a partial side view of the present invention.

Please refer to FIG. 5 and FIG. 6, they are two better and practical examples of this invention. The key point is to use bolt 282 and nut 283 to bolt two bent chip 28 of the rear floor-rod through the piercing hole 281. There is another one pulling board 30 transversely pivoted. A pivot lug 31 is installed at central portion of pulling board 30 where the adjustment screw rod 32 can be pivoted by using bolt 311 and nut 312. Then let this screw rod 32 pass through the holes 213 & 214 drilled on the front & rear partition boards 211 & 212. Afterward, place a buffer pad 33 and two pieces of pad 331 & 332 along the screw rod (32) and in between front and rear partition boards 211 & 212. Finally, use one screw rod socket 34, one pad piece 35 and one knob 36 to position and bolt them together outside the partition board 212 of the framework 21.

When the user is standing on jogging track 27 of the framework 21 and start his jogging exercises, the gravity will be transferred downward to pass through front and rear floor-rod 22 & 24, and finally reach floor surface 40. Because of the joint angle formed by rear floor-rod 24 and framework 21 is in a slant status, therefore the gravity will be adequately and transversely led to screw rod 32. Then the buffer pad 33 assembled on screw rod 32 will begin its work to effectively absorb the gravity when framework 21 and jogging board is bearing the load. It can also lessen the reaction force fed back by floor surface 40. Furthermore, it can weaken the vibration phenomena caused by the framework 21 and jogging board 226 when they are loaded.

We may conclude that buffer pad 33 will effectively absorb the stress generated by longitudinal gravity up and down because of user's jogging movement and the reaction force fed back transversely to it from floor surface 40 through the aid of the slantly assembled rear floor-rod 24. The influence caused by stress and done to framework is largely weakened.

What is claimed is:

1. A buffer structure for a jogging machine having a framework movably supporting a jogging track, the framework having side frames, first and second partition boards extending transversely between the side frames, and a floor support assembly supporting the framework on a floor surface, the floor support assembly pivotally connected to the framework so as to pivot about a transverse pivot axis, the buffer structure comprising:

a) an adjustment screw rod extending through the first and second transverse partition boards, the adjustment screw rod having a threaded first end and a second end;

b) a tubular buffer pad mounted on the adjustment screw rod, the buffer pad located between the first and second transverse partition boards;

c) a pulling board attached to the floor support assembly at a location spaced from the transverse pivot axis;

d) a connection device connecting the second end of the adjustment screw rod to the pulling board; and, e) an adjusting knob mounted on the threaded end of the adjustment screw rod.

2. The buffer structure of claim 1 wherein the connection device comprises a clevis connection.

3. The buffer structure of claim 1 further comprising a screw rod socket interposed between the adjusting knob and an adjacent partition board.

* * * * *